US010185286B2

(12) United States Patent
Okamoto et al.

(10) Patent No.: US 10,185,286 B2
(45) Date of Patent: Jan. 22, 2019

(54) IMAGE FORMING APPARATUS AND CARTRIDGE

(71) Applicant: Brother Kogyo Kabushiki Kaisha, Nagoya-shi, Aichi-ken (JP)

(72) Inventors: Yoshihiro Okamoto, Komaki (JP); Yusuke Ikegami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/716,604

(22) Filed: Sep. 27, 2017

(65) Prior Publication Data

US 2018/0088525 A1 Mar. 29, 2018

(30) Foreign Application Priority Data

Sep. 27, 2016 (JP) ..... 2016-188210

(51) Int. Cl.
*G03G 21/16* (2006.01)
*G03G 21/18* (2006.01)

(52) U.S. Cl.
CPC ..... *G03G 21/1853* (2013.01); *G03G 21/1647* (2013.01); *G03G 2221/1853* (2013.01); *G03G 2221/1884* (2013.01)

(58) Field of Classification Search
CPC ..... G03G 15/0896; G03G 21/16; G03G 21/1609; G03G 21/1647; G03G 21/1853; G03G 2221/1853; G03G 2221/1884
See application file for complete search history.

(56) References Cited

U.S. PATENT DOCUMENTS 7,212,769 B2 * 5/2007 Nishimura ..... G03G 21/1853 399/111
2005/0191088 A1 9/2005 Nishimura

FOREIGN PATENT DOCUMENTS

| | | | |
|---|---|---|---|
| JP | H04-212973 | A | 8/1992 |
| JP | H07-302007 | A | 11/1995 |
| JP | 2005-173171 | A | 6/2005 |
| JP | 2005-242068 | A | 9/2005 |

* cited by examiner

*Primary Examiner* — Hoang Ngo
(74) *Attorney, Agent, or Firm* — Banner & Witcoff, Ltd.

(57) ABSTRACT

An image forming apparatus includes a casing, a photosensitive member, an exposing device, a cartridge attachable to and removable from the casing, a protruding portion protruding toward a removal path along which the cartridge is removed, and a guide portion disposed on the cartridge. The guide portion is configured to, when the cartridge is attached to the casing, guide a sheet toward the photosensitive member. The guide portion is movable relative to the cartridge between a guide position where the guide portion guides a sheet and a retracted position where the guide portion is retracted from the protruding portion when the cartridge is removed from the casing.

18 Claims, 12 Drawing Sheets

IMAGE FORMING APPARATUS AND CARTRIDGE

CROSS-REFERENCE TO RELATED APPLICATION

This application claims priority from Japanese Patent Application No. 2016-188210 filed on Sep. 27, 2016, the content of which is incorporated herein by reference in its entirety.

FIELD OF DISCLOSURE

The present disclosure relates to an image forming apparatus including a photosensitive member and an exposing device and configured to form an image on a sheet by an electrophotographic method, and relates to a cartridge detachably attached to the image forming apparatus.

BACKGROUND

Some known electrophotographic image forming apparatus including a photosensitive member and an exposing device for forming an image on a sheet (for example, paper) are configured such that developer to be supplied to the photosensitive member is contained in a cartridge, and the cartridge is detachably attached to a housing. In this case, when developer runs out, the cartridge used until then can be removed from the housing, and a new cartridge can be attached to the housing.

In one of such image forming apparatuses, a proposal of a cartridge with a chute that guides a sheet toward the photosensitive member has been made. This can reduce the size of the image forming apparatuses compared to a configuration in which a cartridge and a chute are separately provided.

Furthermore, this type of image forming apparatus includes a multi-feed tray protruding from a side of the apparatus, in addition to a feed tray disposed at a lower portion of the apparatus, so that an image can also be formed on a sheet supplied from the multi-feed tray.

A conveyor for conveying a sheet placed on the multi-feed tray is disposed at an upper portion of the multi-feed tray. In such an image forming apparatus, a cartridge is removed from above the multi-feed tray.

SUMMARY

According to an aspect of the disclosure, an image forming apparatus includes a casing having an opening, a photosensitive member disposed in the casing and configured to carry developer to be transferred onto a sheet, an exposing device disposed in the casing and configured to expose the photosensitive member to light, a cartridge, a protruding portion, and a guide portion. The cartridge is disposed in the casing and configured to be attached to and removed from the casing through the opening. The cartridge is configured to store developer to be supplied to the photosensitive member exposed by the exposing device. The protruding portion is disposed in the casing. The protruding portion protrudes toward a removal path along which the cartridge is removed. The removal path communicates with the opening of the casing. The guide portion is disposed on the cartridge and configured to, when the cartridge is attached to the casing, guide a sheet toward the photosensitive member. The guide portion is movable relative to the cartridge between a guide position where the guide portion guides a sheet and a retracted position where the guide portion is retracted from the protruding portion when the cartridge is removed from the casing.

As the guide portion is movable relative to the cartridge, when the cartridge is attached to the casing, the guide portion is located at the guide position and can guide a sheet toward the photosensitive member. When the cartridge is removed from the casing, the guide portion moves toward the retracted position. This structure reduces interference of the guide portion with the protruding portion protruding toward the removal path when the cartridge is removed from the casing. This structure also reduces the need to increase the physical size of the image forming apparatus due to increase in complexity.

According to another aspect of the disclosure, a cartridge for use in an image forming apparatus is provided. The image forming apparatus includes a casing, a photosensitive member disposed in the casing and configured to carry developer to be transferred onto a sheet, and an exposing device disposed in the casing and configured to expose the photosensitive member to light. The cartridge is configured to be attached to and removed from the casing of the image forming apparatus. The cartridge includes a frame and a guide portion configured to guide a sheet toward the photosensitive member. The guide is movable relative to the frame between a guide position where the guide portion guides the sheet and a retracted position spaced apart from the guide position in a direction away from a conveying path of the sheet.

As the guide portion is movable relative to the frame, when the cartridge is attached to the casing, the guide portion is located at the guide position and can guide a sheet toward the photosensitive member. When the cartridge is removed from the casing, the guide portion moves toward the retracted position away from the conveying path. This structure reduces interference of the guide portion with the protruding portion protruding toward the removal path when the cartridge is removed from the casing. This structure also reduces the need to increase the physical size of the image forming apparatus due to increase in complexity.

DETAILED DESCRIPTION

Figure 1:
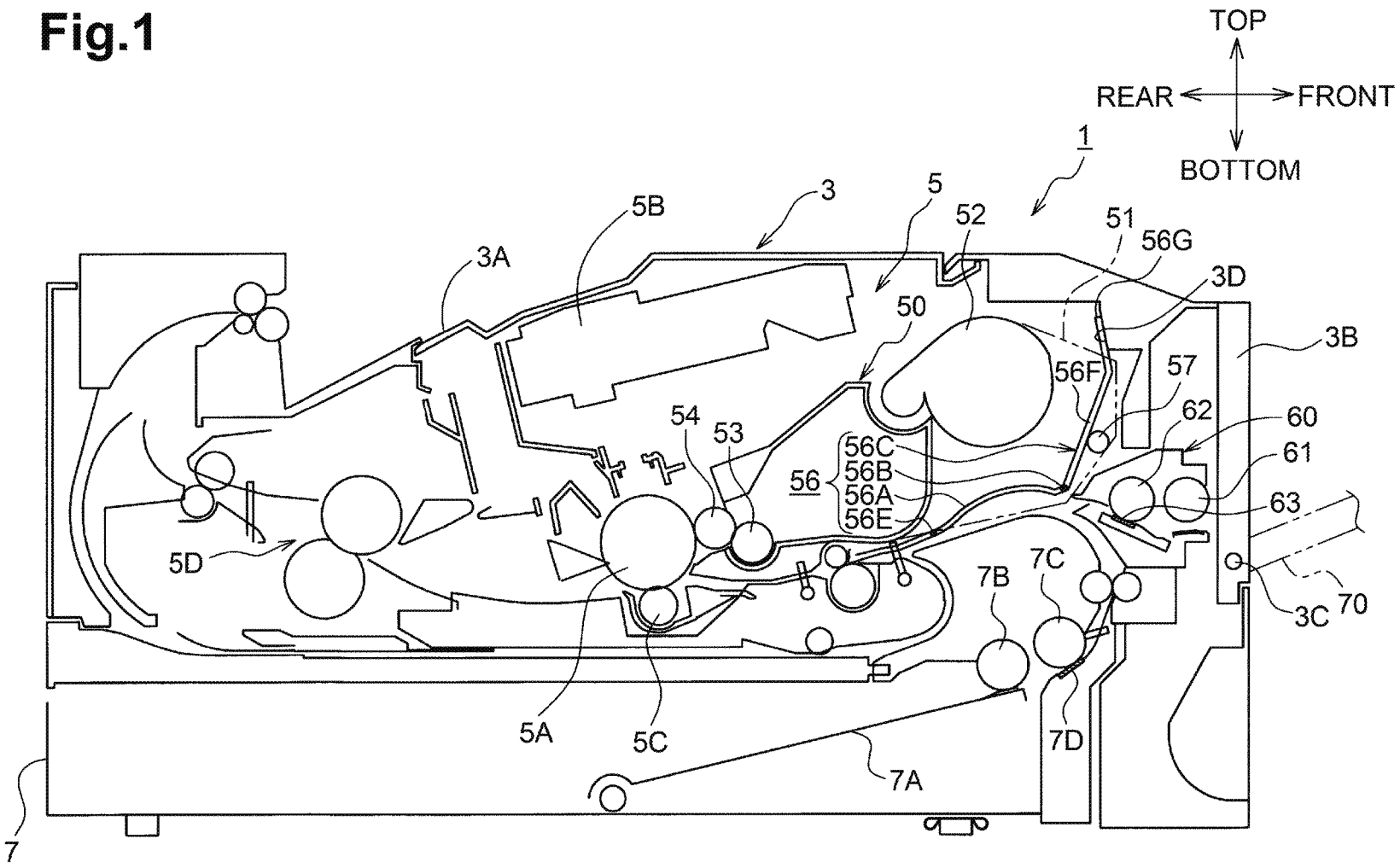
FIG. 1 is a cross-sectional view of an image forming apparatus according to a first embodiment of the present disclosure illustrating the configuration thereof.

"Embodiment of the present disclosure" described below illustrates an example embodiment. In other words, it is to be understood that the features of the present disclosure described in the scope of the claims are not limited to the specific means and structures illustrated in the following embodiments.

The embodiments are applications of the present disclosure to an image forming apparatus 1 for monochrome printing. For ease of discussion, in the following description, the top or upper side, the bottom or lower side, the left or left side, the right or right side, the front or front side, and the rear or rear side of the image forming apparatus 1 will be identified as indicated by the arrows in FIG. 1. With regard to various individual objects of the image forming apparatus 1, sides of the individual objects will be similarly identified based on the arranged/attached position of the object on/in the image forming apparatus 1 shown in FIG. 1.

For a member or part that will be described below with at least a reference numeral or reference characters assigned, the number of members or parts provided is one except a case in which "a plurality of" or "two or more" is described. Embodiments of the present disclosure will be described with reference to the drawings.

First Embodiment

General Description of Image Forming Apparatus

As illustrated in FIG. 1, an image forming apparatus 1 includes an image forming device 5 in a housing 3. An output tray 3A is provided on the upper surface of the housing 3. A front cover 3B (corresponding to an example a cover) is mounted to the front of the housing 3 so as to be rotatable about a hinge 3C extending in the left-right direction. A feed tray 7 is detachably attached to the bottom of the housing 3.

The image forming device 5 is a device configured to form an image on a sheet, such as paper, by an electrophotographic method. Specifically, the image forming device 5 includes a photosensitive drum 5A (corresponding to an example of a photosensitive member), an exposing device 5B, a transfer roller 5C, a fixing device 5D, a process cartridge 50 (corresponding to an example of a cartridge), and so on. The configuration of the process cartridge 50 will be described later.

The photosensitive drum 5A rotates clockwise in FIG. 1 during image formation. At that time, the surface of the photosensitive drum 5A is charged by a charger (not shown) and is then exposed to light by the exposing device 5B so that an electrostatic latent image is formed thereon. The electrostatic latent image on the photosensitive drum 5A is developed with developer supplied from the process cartridge 50 and is carried on the photosensitive drum 5A as a developer image. The transfer roller 5C transfers the developer image carried on the photosensitive drum 5A to a sheet. The fixing device 5D fixes the developer image onto the sheet. The sheet, on which the developer image is fixed, is reversed through a discharge path located at a rear portion of the image forming apparatus 1 and is thereafter discharged onto the output tray 3A on the upper surface of the housing 3.

The feed tray 7 is detachably mounted to the housing 3 below the elements of the image forming device 5. The feed tray 7 includes a sheet lifting plate 7A (corresponding to an example of a first sheet receiving portion) therein. The sheet lifting plate 7A is configured to hold sheets in a stacked manner on its upper surface and is rotatable about its rear end. The front end of the sheet lifting plate 7A is urged upward by a spring (not shown).

The housing 3 contains a feed roller 7B, a separation roller 7C, a separation pad 7D (each corresponding to an example of a first sheet conveyor), and so on as a configuration for conveying the uppermost sheet of the sheets stacked on the sheet lifting plate 7A toward the image forming device 5. The feed roller 7B feeds the uppermost sheet of the plurality of stacked sheets toward the image forming device 5 by rotating in contact with the uppermost sheet from above in the vertical direction. The separation roller 7C rotates in contact with the sheet fed from the feed roller 7B from above in the vertical direction. The separation pad 7D is disposed at a position facing the separation roller 7C and offers conveying resistance to the sheet. Thus, when a few sheets are fed out from the feed roller 7B, the sheets are separated one by one and sent toward the image forming device 5.

2. Detailed Configuration of Process Cartridge and Conveyor

The process cartridge 50 includes a frame 51 that forms the outer frame of the process cartridge 50. The process cartridge 50 includes, inside the frame 51, the above-described photosensitive drum 5A, a developer cartridge 52 (corresponding to an example of a storing portion), a supply roller 53, a developing roller 54, a guide mechanism 56, and so on. As illustrated in FIG. 1, when the process cartridge 50 is mounted to the housing 3, the developer cartridge 52 is disposed partially above the guide mechanism 56. When the process cartridge 50 is mounted to the housing 3, the developer cartridge 52 is disposed above and in front of the photosensitive drum 5A, the supply roller 53, and the developing roller 54.

Figure 2:
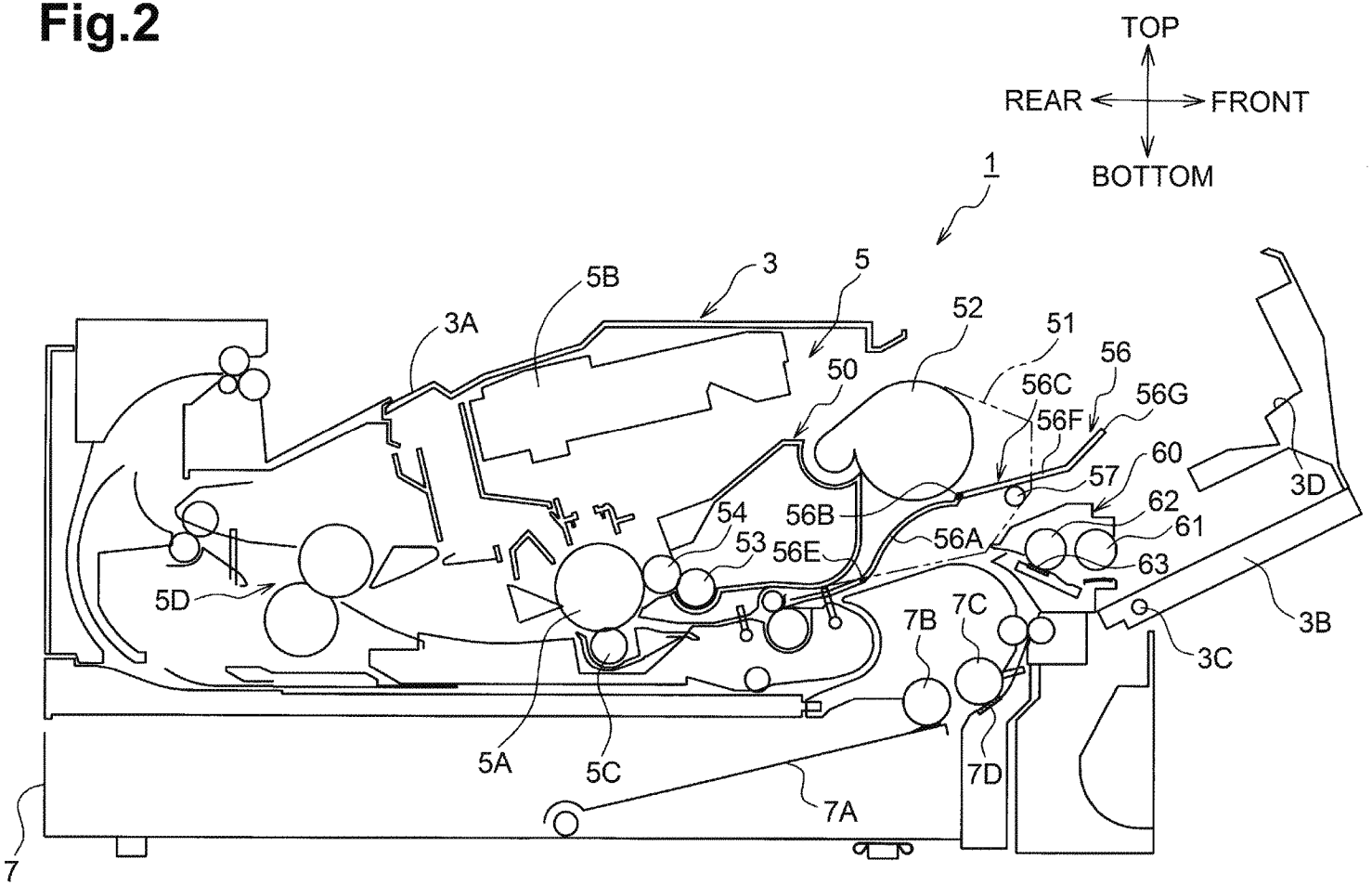
FIG. 2 is a cross-sectional view of the image forming apparatus from which a process cartridge is to be removed.

The hinge 3C that supports the front cover 3B is disposed below the process cartridge 50 mounted to the housing 3. This allows the frame 51 of the process cartridge 50 to be removed through the opening of the housing 3, which is formed when the front cover 3B is open, together with the photosensitive drum 5A, the developer cartridge 52, the supply roller 53, the developing roller 54, and the guide mechanism 56, as illustrated in FIG. 2.

The developer cartridge 52 incorporates an agitator (not shown) and feeds out developer contained therein toward the supply roller 53 while agitating developer with the agitator. The supply roller 53 supplies developer to the developing roller 54 while frictionally charging developer between the supply roller 53 and the developing roller 54. The developing roller 54 supplies the developer supplied from the supply roller 53 to the surface of the photosensitive drum 5A while further frictionally charging it. Thus, the electrostatic latent image is developed as described above.

The guide mechanism 56 includes a chute 56A (corresponding to an example of a guide portion) and a handle portion 56C (corresponding to an example of a particular part connected to the guide portion and also corresponding to an example of an extending portion) rotatably connected to the chute 56A via a hinge 56B. The chute 56A is rotatably attached to the frame 51 via a hinge 56E disposed below the rear end of the developer cartridge 52 so as to extend in the left-right direction.

The chute 56A has a rear end attached to the hinge 56E and a front end at which the hinge 56B is disposed, and an upward protruding curved surface between the rear end and front end. The hinge 56E is configured so that, when the chute 56A is disposed at a guide position (see FIG. 1) where the hinge 56B is disposed a predetermined amount lower than the apex (that is, the top end) of the curved surface constituting the chute 56A, the chute 56A does not rotate to a position lower than the guide position. As illustrated in FIG. 1, when the chute 56A is disposed at the guide position, a sheet sent from the separation roller 7C contacts the chute 56A and the chute 56A receives and guides the sheet toward the photosensitive drum 5A along the curved surface (that is, the lower surface) of the chute 56A.

Figure 3:
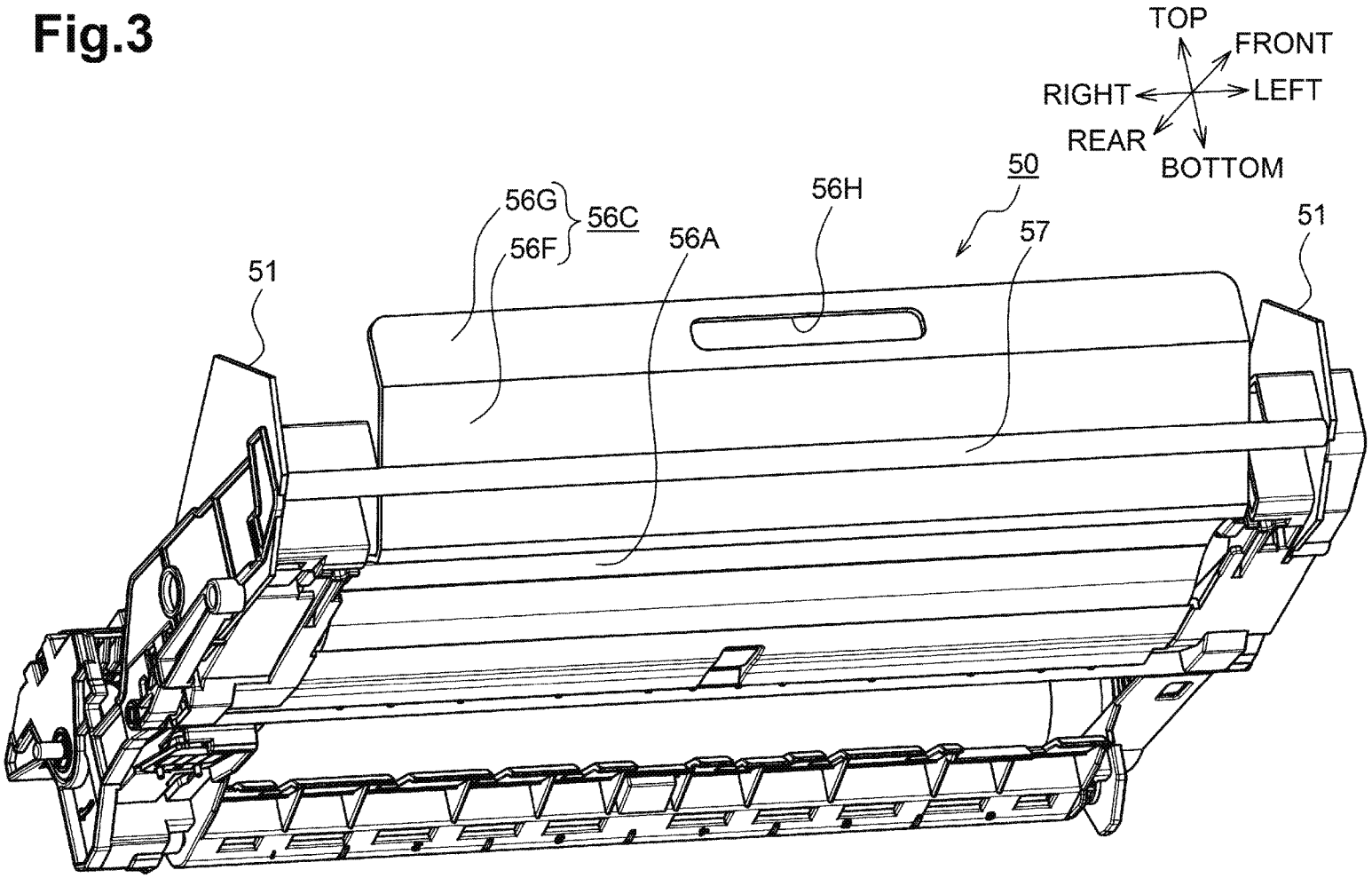
FIG. 3 is a perspective view of the process cartridge illustrating the configuration thereof.

As illustrated in FIG. 3, the handle portion 56C includes a plate portion 56F and a handle 56G. The plate portion 56F has a rectangular plate shape, one side of which is connected to the chute 56A via the hinge 56B (see FIG. 1). The handle 56G is connected to the other side of the plate portion 56F opposite to the one side, and shaped like a flat plate having a long hole 56H extending in the left-right direction in its center. The handle 56G is integral with the plate portion 56F such that the handle 56G is bent toward the developer cartridge 52 at an obtuse angle relative to the plate portion 56F.

As illustrated in FIG. 1, when the front cover 3B is closed, the handle 56G is in contact with a planar contact surface 3D forming an upper inner surface of the front cover 3B, so that the handle portion 56C is supported at a standing position where the handle portion 56C extends upward from the hinge 56B. When the handle portion 56C is located at the standing position, a front surface (that is, an outer surface) of the plate portion 56F is in contact with a columnar shaft 57 (corresponding to an example of a conversion portion) extending in the left-right direction in the frame 51. The handle portion 56C, when located at the standing position, has a center of gravity, which is positioned further to the front than the shaft 57. The center of gravity may be adjusted by changing the thicknesses of the handle portion 56C or the disposition of recessed portions (not shown). The handle portion 56C and the shaft 57 correspond to an example of a moving portion.

A multi-purpose (MP) tray 70 (corresponding to an example of a second sheet receiving portion) can be mounted to the front surface (that is, the outer surface) of the front cover 3B in a closed state. A conveyor 60 (corresponding to an example of a protruding portion and a second sheet conveyor) for conveying sheets stacked on the MP tray 70 is provided in the housing 3. The conveyor 60 includes a feed roller 61, a separation roller 62, a separation pad 63, and so on.

The feed roller 61 comes into contact with the uppermost sheet of the sheets stacked on the MP tray 70 and inserted into the housing 3 through a hole (not shown) in the front cover 3B, from above in the vertical direction. As the feed roller 61 rotates, the sheet is fed toward the image forming device 5. The separation roller 62 rotates in contact with the sheet fed out from the feed roller 61 from above in the vertical direction. The separation pad 63 is disposed at a position facing the separation roller 62 and offers conveying resistance to the sheet. With this configuration, when a plurality of sheets are fed out from the feed roller 61, the sheets are separated one by one and fed toward the image forming device 5. Thus, the chute 56A also guides the sheets fed out from the conveyor 60 toward the photosensitive drum 5A.

The above-described shaft 57 disposed in the process cartridge 50 is designed to be disposed above the conveyor 60 in a state in which the process cartridge 50 is mounted in the housing 3.

3. Operation of Process Cartridge

Figure 4:
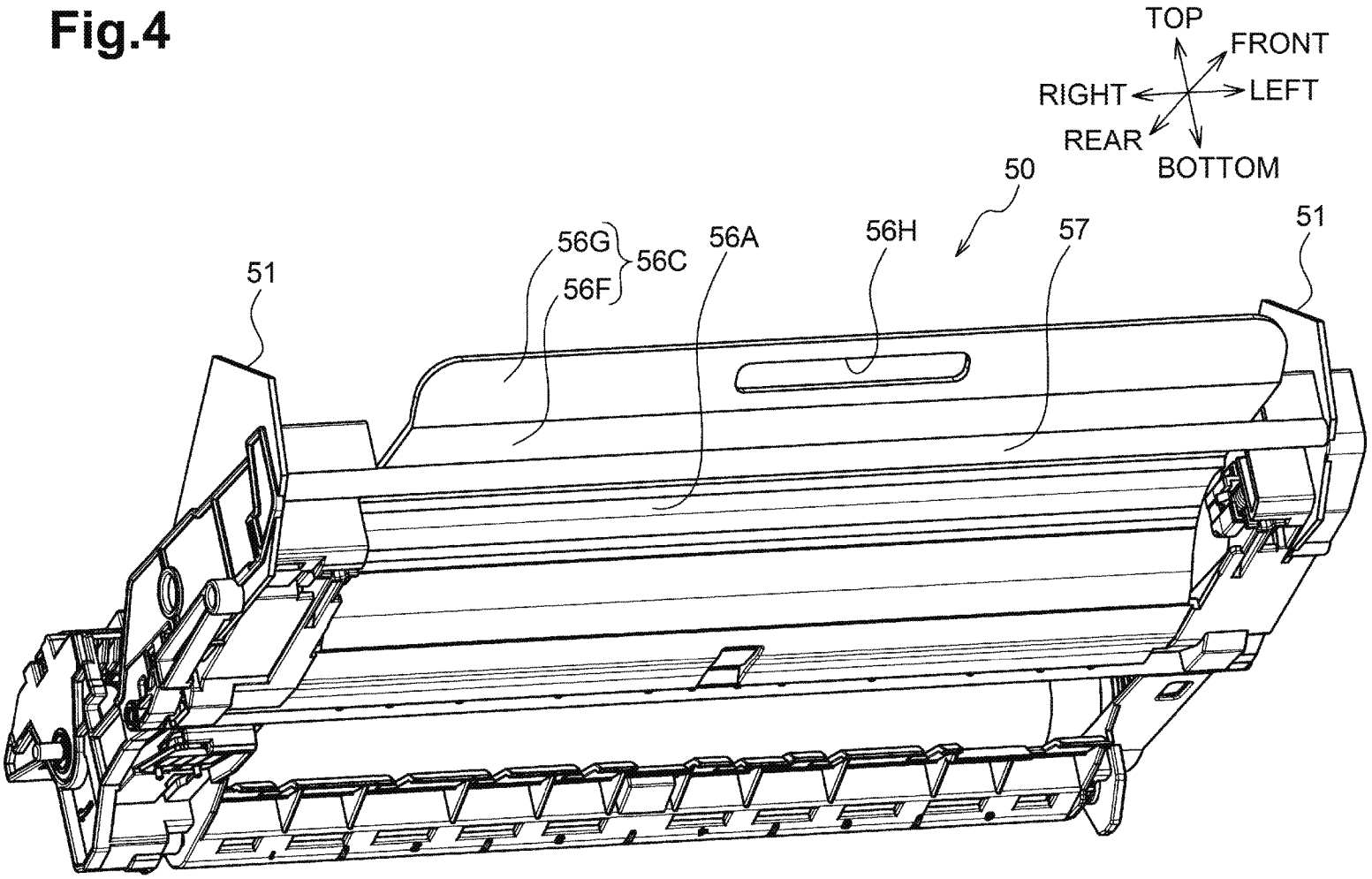
FIG. 4 is a perspective view of the process cartridge illustrating the operation in FIG. 2.

As illustrated in FIG. 2, when the front cover 3B is open, the contact surface 3D does not contact the handle 56G. Since the center of gravity of the handle portion 56C located at the standing position is positioned further to the front than the shaft 57, as described above, the handle portion 56C falls forward with the shaft 57 as a fulcrum. Then, the front end of the chute 56A, connected via the hinge 56B to the handled portion 56C, moves upward. In other words, the process cartridge 50 changes in shape from the state illustrated in FIG. 3 to the state illustrated in FIG. 4. At this time, the chute 56A is located at a retracted position. More specifically, as illustrated in FIG. 2, the front end of the chute 56A is retracted above the conveyor 60. This retraction reduces the chute 56A from interfering with the conveyor 60 at the removal of the process cartridge 50. Moreover, by the user inserting a finger into the long hole 56H of the handle 56G and pulling it, the chute 56A is stably maintained in the retracted position, further preventing the interference.

4. Advantageous Effects of First Embodiment

The first embodiment described above offers the following advantageous effects.

(1A) As the process cartridge 50 is provided with the chute 56A, the need to increase the physical size of the image forming apparatus 1 is reduced. In addition, the chute 56A moves to the retracted position in conjunction with the opening of the front cover 3B. This structure reduces the chute 56A from interfering with the conveyor 60 protruding to a removal path at the removal of the process cartridge 50 from the housing 3.

Figure 5:
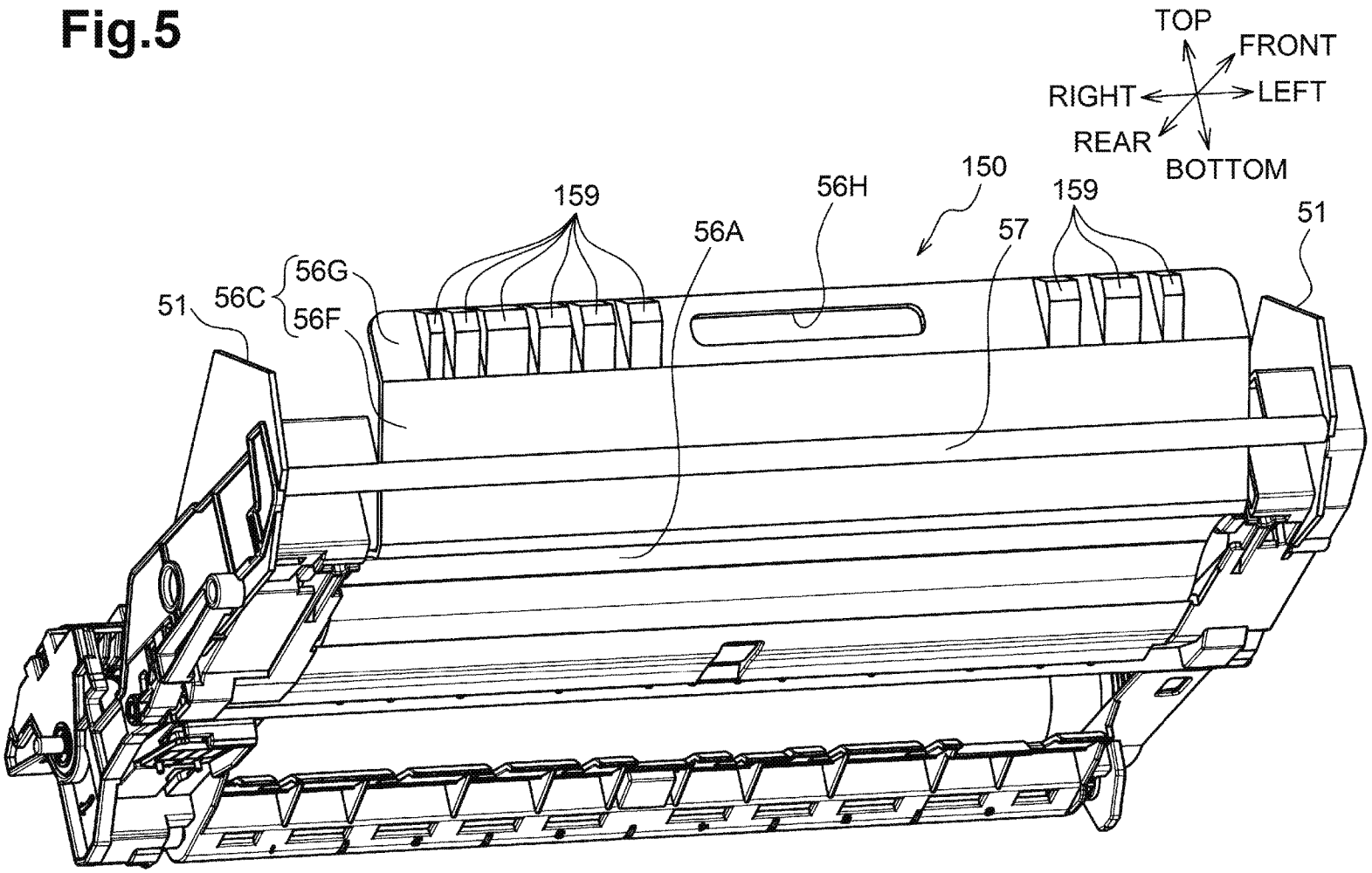
FIG. 5 is a perspective view of a process cartridge of a different type of image forming apparatus illustrating the configuration thereof.
Figure 6:
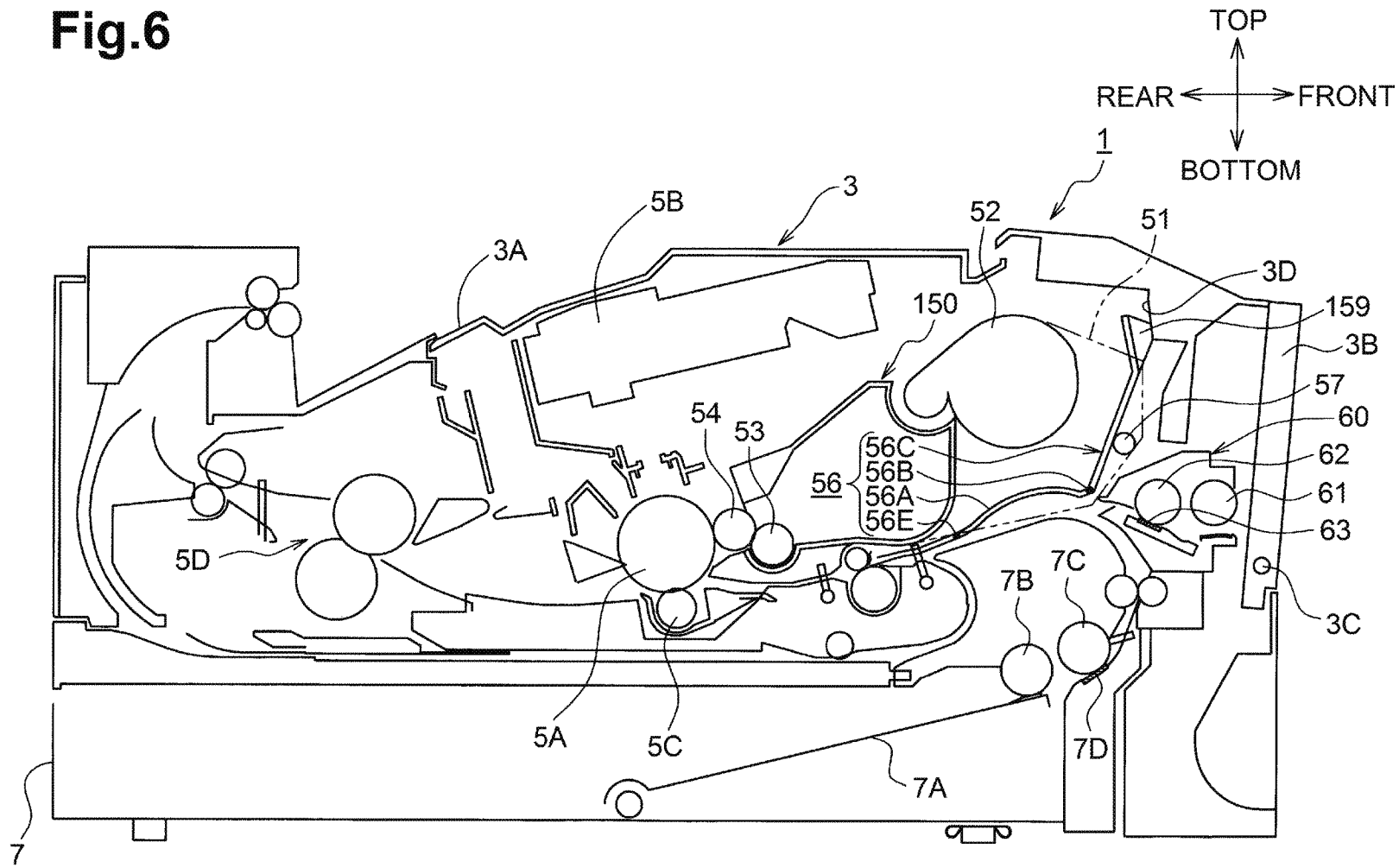
FIG. 6 is a cross-sectional view of the image forming apparatus illustrating a state in which the process cartridge of FIG. 5 is mounted.

(1B) The flat contact surface 3D is in contact with the plate-like handle 56G when the front cover 3B is closed. For example, when a process cartridge 150 of a different type including protruding portions 159 on the outer surface of the handle 56G (that is, a surface that comes into contact with the contact surface 3D), as illustrated in FIG. 5, is mounted to the housing 3, the protruding portions 159 interfere with the front cover 3B (more specifically, the contact surface 3D), so that the front cover 3B cannot be closed, as illustrated in FIG. 6. This prevents the process cartridge 150 of the different type from being mounted to the image forming apparatus 1 by mistake.

(1C) Since the advantageous effect of (1B) is given only by changing the shape of the handle 56G (also the shape of the contact surface 3D as needed), the other configurations can be common among different types. This reduces the overall manufacturing cost of image forming apparatuses constituting one series.

(1D) In the present embodiment, when the process cartridge 50 is removed, the chute 56A moves from the guide position to the retracted position before coming into contact with the conveyor 60. This makes the durability of the chute 56A and the conveyor 60 less prone to wear. Moreover, the chute 56A moves to the retracted position in conjunction with the opening of the front cover 3B. This makes it easy for the user to move the chute 56A to the retracted position and eliminates the need for the user to remember to move the chute 56A to the retracted position.

(1E) Furthermore, a movement of the handle portion 56C falling down in conjunction with the opening of the front cover 3B is converted to a movement of the chute 56A to the retracted position, which simplifies the configuration.

(1F) Furthermore, a movement of the handle 56G being pulled in the removing direction of the process cartridge 50 is converted to the movement of the chute 56A to the retracted position, which allows the chute 56A to be more reliably held at the retracted position at the removal of the process cartridge 50. This more advantageously prevents the chute 56A from interfering with the conveyor 60, further making the chute 56A and the conveyor 60 less prone to wear.

(1G) The chute 56A is configured to move from the guide position to the retracted position by rotating about the hinge 56E in a direction in which the chute 56A moves away from a sheet conveying path along which a sheet is conveyed. This eliminates the need for a configuration, such as a guide for parallel translation, as compared with a case in which the chute 56A translates (that is, slides), simplifying the configuration of the apparatus.

(1H) When the process cartridge 50 is mounted, the developer cartridge 52 is disposed above the chute 56A. When the developer cartridge 52 is disposed above in this manner, developer can be smoothly fed to the supply roller 53 using gravity. Furthermore, the chute 56A can be retracted using a space defined between the developer cartridge 52 and the chute 56A.

(1I) The chute 56A is configured to move to the guide position in conjunction with the closing of the front cover 3B. This prevents the user from forgetting to set the chute 56A at the guide position after mounting the process cartridge 50.

Second Embodiment

Figure 7:
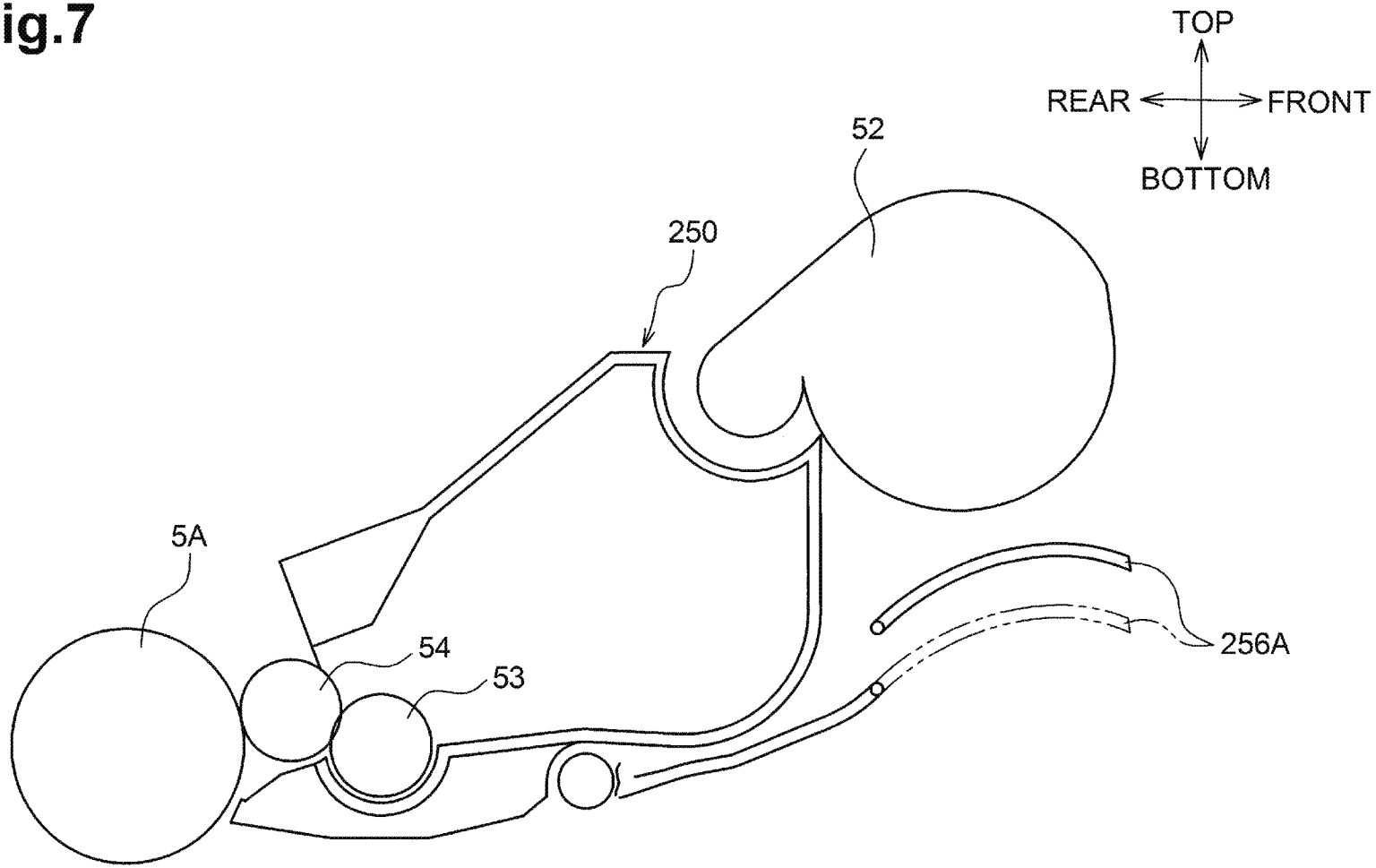
FIG. 7 is a cross-sectional view of a process cartridge according to a second embodiment of the present disclosure illustrating the configuration thereof.

FIG. 7 is a cross-sectional view of a process cartridge 250 (corresponding to an example of a cartridge) of an image forming apparatus according to a second embodiment. The process cartridge 250 differs from the process cartridge 50 in that a chute 256A (corresponding to an example of a guide portion), which is similar in function to the chute 56A, is capable of translating in the vertical direction (or in a direction close to/away from the developer cartridge 52. The process cartridge 250 is substantially similar in configuration to the process cartridge 50 except for the above. In FIG. 7, elements similar to or identical with those of the process cartridge 50 are designated by similar numerals, and thus the description thereof can be omitted for the sake of brevity. A configuration for translating the chute 256A as described above can be a known configuration, such as a guide provided for the frame (not shown) of the process cartridge 250, and therefore it is not described here in detail.

The chute 256A translates upward (that is, a direction closer to the developer cartridge 52) in conjunction with the opening of the front cover of the image forming apparatus of the second embodiment and translates downward (that is, a direction away from the developer cartridge 52) in conjunction with the closing of the front cover. For that configuration, a known configuration, such as a link mechanism between the front cover and the chute 256A, can be applied, and therefore a detailed description thereof will be omitted here.

Also in the thus-configured image forming apparatus of the second embodiment, the chute 256A moves between the guide position and the retracted position in conjunction with the opening and closing of the front cover, and the same advantageous effects as those of (1A), (1D), (1H), and (1I) are given.

Alternatively, the chute 256A may be configured to move to the retracted position by translating owing to a movement in which a handle (not shown) of the process cartridge 250 is pulled in the removing direction of the process cartridge 250. This configuration offers the same advantageous effect as that of (1F).

Third Embodiment

Difference from First Embodiment

Figure 8:
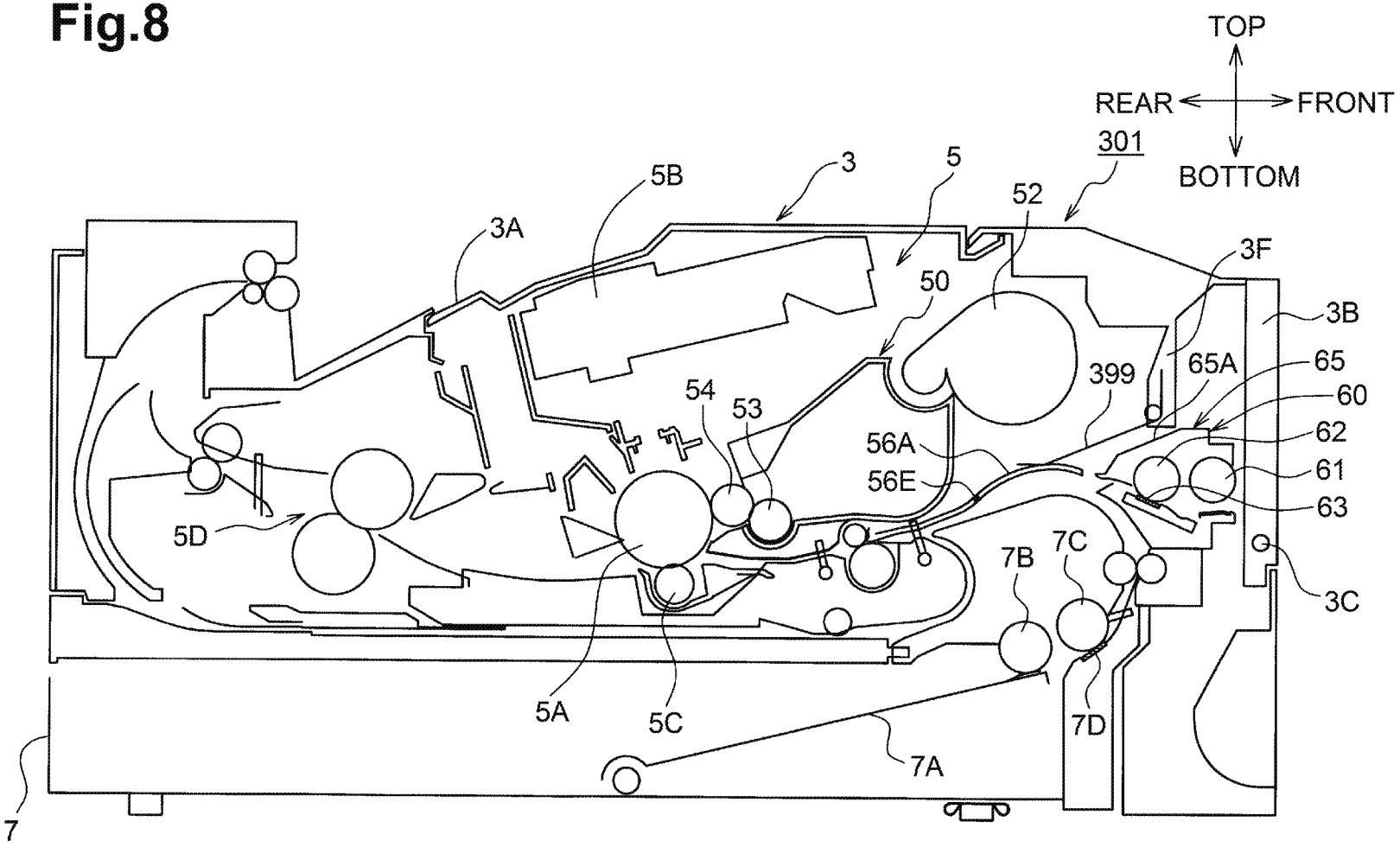
FIG. 8 is a cross-sectional view of an image forming apparatus according to a third embodiment of the present disclosure illustrating the configuration thereof.

An image forming apparatus 301 according to a third embodiment illustrated in FIG. 8 differs from the image forming apparatus 1 in that the hinge 56B and the handle portion 56C of the guide mechanism 56 and the contact surface 3D of the front cover 3B are omitted and that the front cover 3B includes a spring 399 (corresponding to an example of an urging device). The image forming apparatus 301 is substantially similar in configuration to the image forming apparatus 1 except for the above. In FIG. 8, elements similar to or identical with those in the first embodiment are designated by similar numerals, and thus the description thereof can be omitted for the sake of brevity.

In the present embodiment, the handle portion 56C is absent. Therefore, even if the front cover 3B is opened, a force to cause the chute 56A to move to the retracted position does not act, and the chute 56A is held at the guide position by its own weight. The shaft and one end of the spring 399, which is e.g. a torsional spring, are fixed to a spring bearing 3F provided at an inner portion of the front cover 3B. When the front cover 3B is closed, the other end of the spring 399 makes contact with the chute 56A from above to urge the chute 56A downward (a direction from the retracted position to the guide position). Therefore, even if the chute 56A located at the guide position receives an upward force greater than its own weight from a sheet guided by the chute 56A, the chute 56A is prevented from moving from the guide position.

Figure 9:
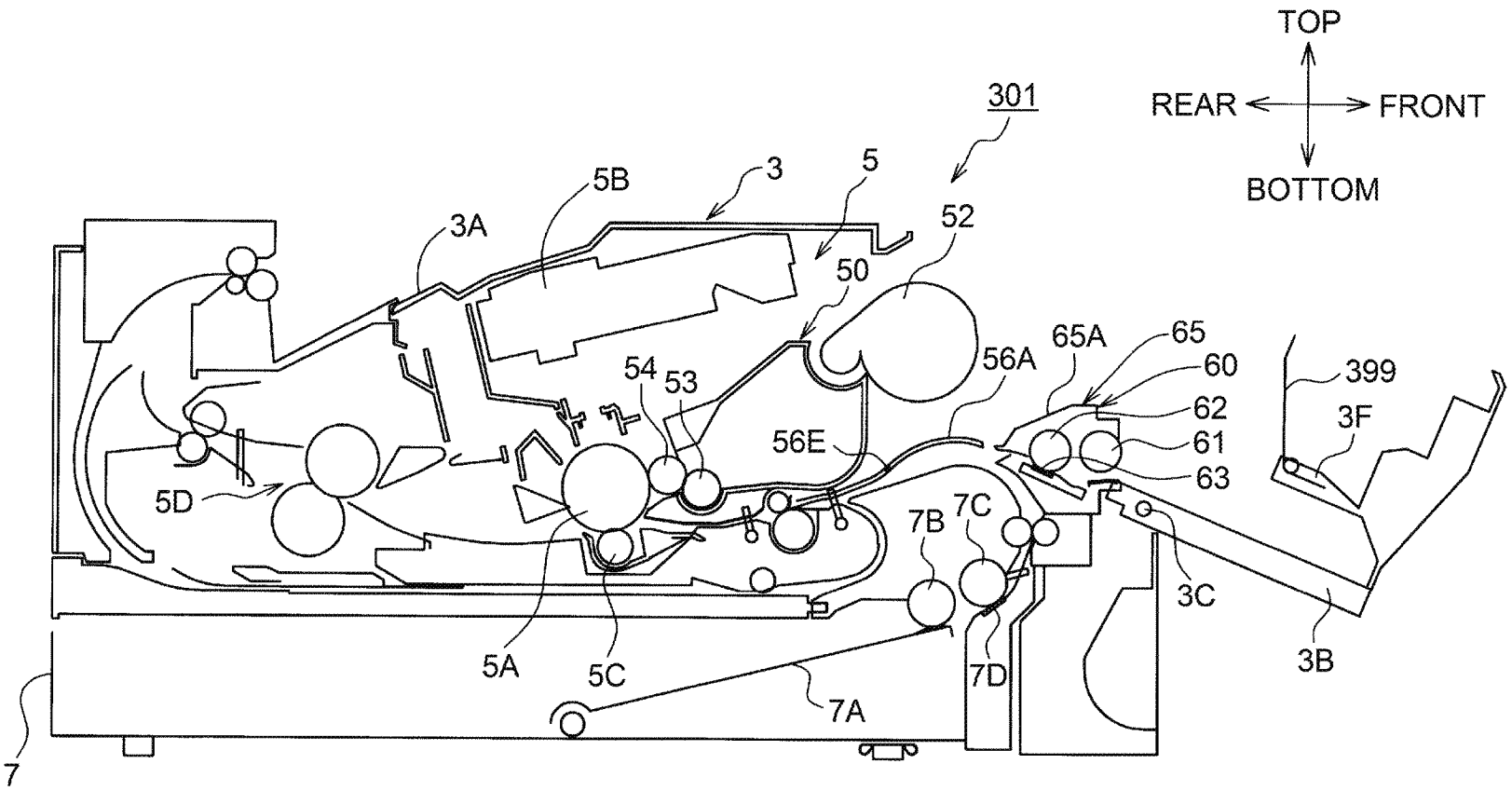
FIG. 9 is a cross-sectional view of the image forming apparatus from which a process cartridge is to be removed.

As illustrated in FIG. 9, when the front cover 3B is open, the spring 399 attached to the front cover 3B is away from the chute 56A. The chute 56A easily moves from the guide position to the retracted position when it receives an upward force greater than its own weight.

Figure 10:
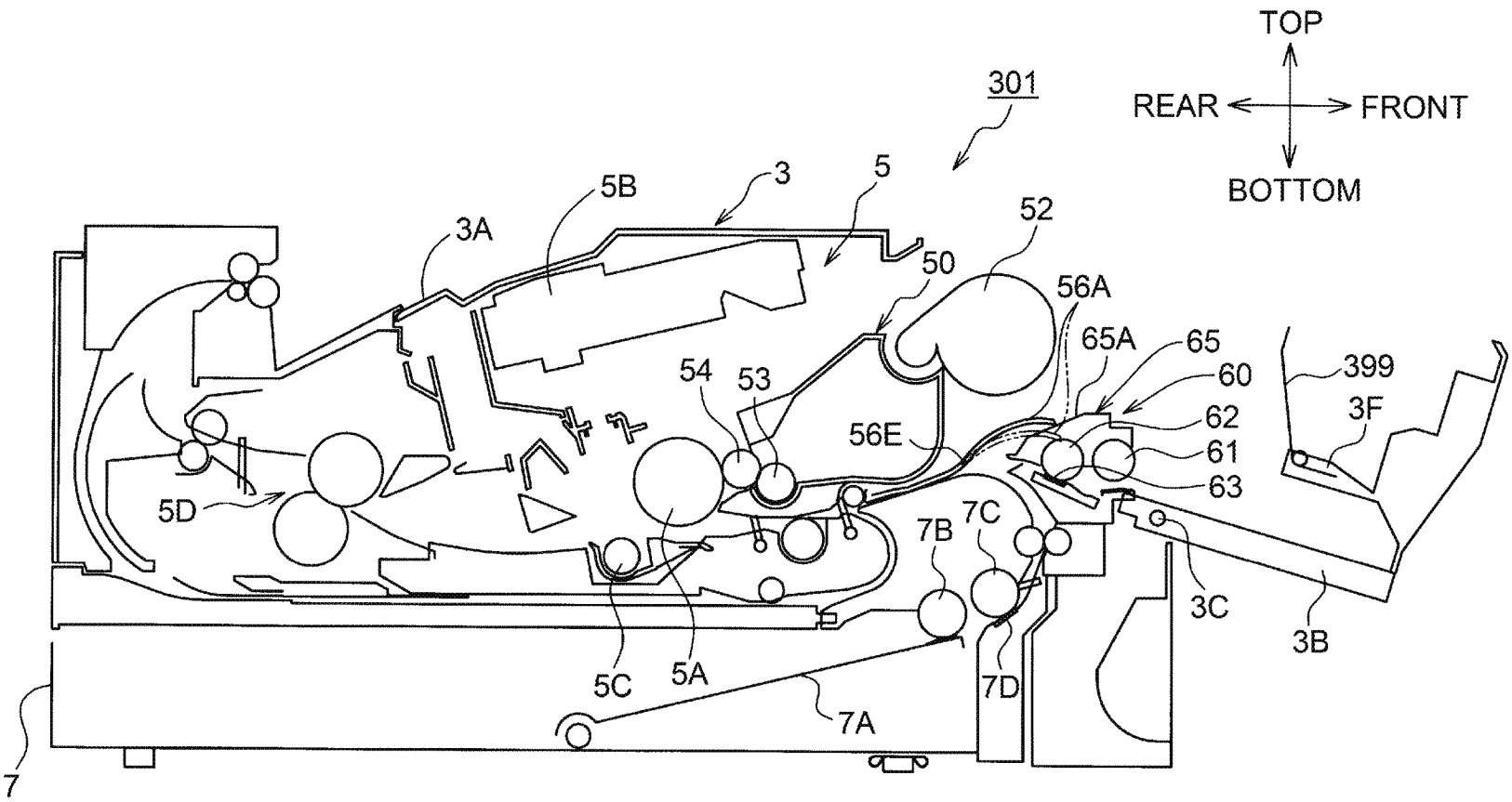
FIG. 10 is a cross-sectional view of the image forming apparatus from which the process cartridge is being removed.

An upper rear surface 65A of a casing 65 of the conveyor 60 is inclined upward toward the front. For that reason, when the chute 56A comes into contact with the surface 65A during removal of the process cartridge 50 from the housing 3, the chute 56A moves, e.g., rotates, from the guide position indicated by the chain double-dashed line to the retracted position indicated by the solid line in a direction away from the conveying path, which are illustrated in FIG. 10, because the hinge 56E is lower than the contact portion. This therefore reduces interference of the chute 56A with the conveyor 60 when the process cartridge 50 is removed.

2. Advantageous Effects of Third Embodiment

The thus-configured image forming apparatus 301 of the third embodiment offers the following advantageous effects in addition to the advantageous effects of (1G), (1H), and (1I) described above.

(3A) In the image forming apparatus 301 of the present embodiment, the chute 56A moves from the guide position to the retracted position by coming into contact with the conveyor 60. This simple structure reduces the interference of the chute 56A with the conveyor 60 at the removal of the process cartridge 50 while preventing an increase in the physical size of the image forming apparatus. Furthermore, the operation for the user to move the chute 56A to the retracted position is simple, which eliminates the need for the user to remember to move the chute 56A to the retracted position.

(3B) When the front cover 3B is closed (that is, the process cartridge 50 is mounted), the spring 399 urges the chute 56A downward. For that reason, even if the chute 56A receives an upward force greater than its own weight from a sheet guided by the chute 56A, the chute 56A is held at the guide position, so that the sheet can be guided satisfactorily. This also reduces vibration of the chute 56A during guiding of the sheet, preventing occurrence of noise.

(3C) When the process cartridge 50 is mounted, the chute 56A is set at the guide position by the urging force of the spring 399.

(3D) The spring 399 is provided at the front cover 3B and is separated from the chute 56A when the front cover 3B is opened. This prevents the chute 56A from coming into strong contact with the surface 65A when the process cartridge 50 is removed.

Fourth Embodiment

Difference from Third Embodiment

Figure 11:
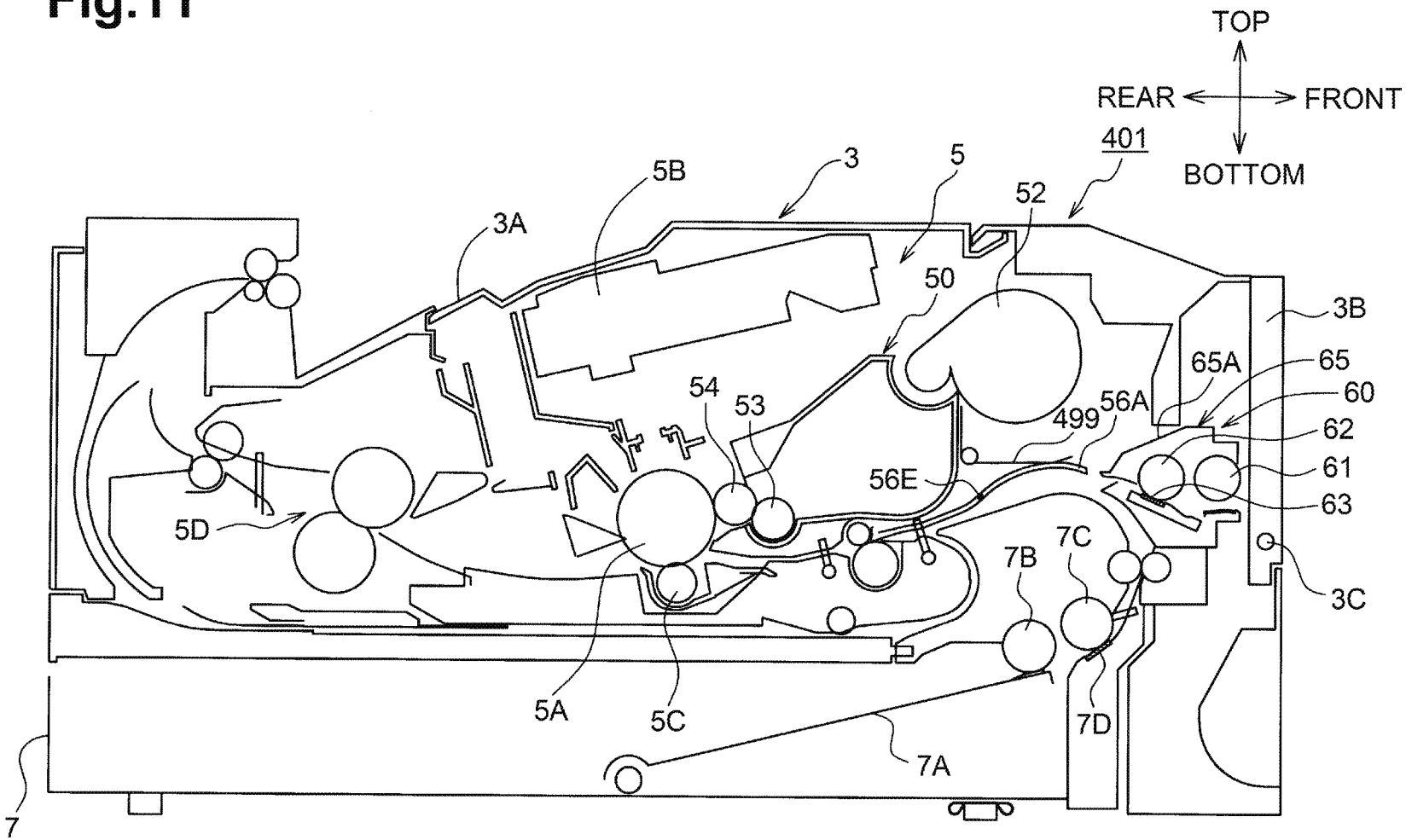
FIG. 11 is a cross-sectional view of an image forming apparatus according to a fourth embodiment of the present discloser illustrating the configuration thereof.

An image forming apparatus 401 of a fourth embodiment illustrated in FIG. 11 differs from the image forming apparatus 301 in that the spring 399 is omitted, and instead of that, a spring 499 (corresponding to an example of the urging device) is provided. The image forming apparatus 401 is substantially similar in configuration to the image forming apparatus 301 except for the above. In FIG. 11, elements similar to or identical with those in the third embodiment are designated by similar numerals, and thus the description thereof can be omitted for the sake of brevity.

In the present embodiment, the shaft and one end of a spring 499, which is e.g. a torsional spring, is fixed to the frame (not shown) of the process cartridge 50. The other end of the spring 499 is in contact with the chute 56A from above to urge the chute 56A downward (that is, a direction from the retracted position to the guide position). Therefore, even if the chute 56A located at the guide position receives an upward force greater than its own weight from a sheet guided by the chute 56A, the chute 56A is prevented from moving from the guide position.

Figure 12:
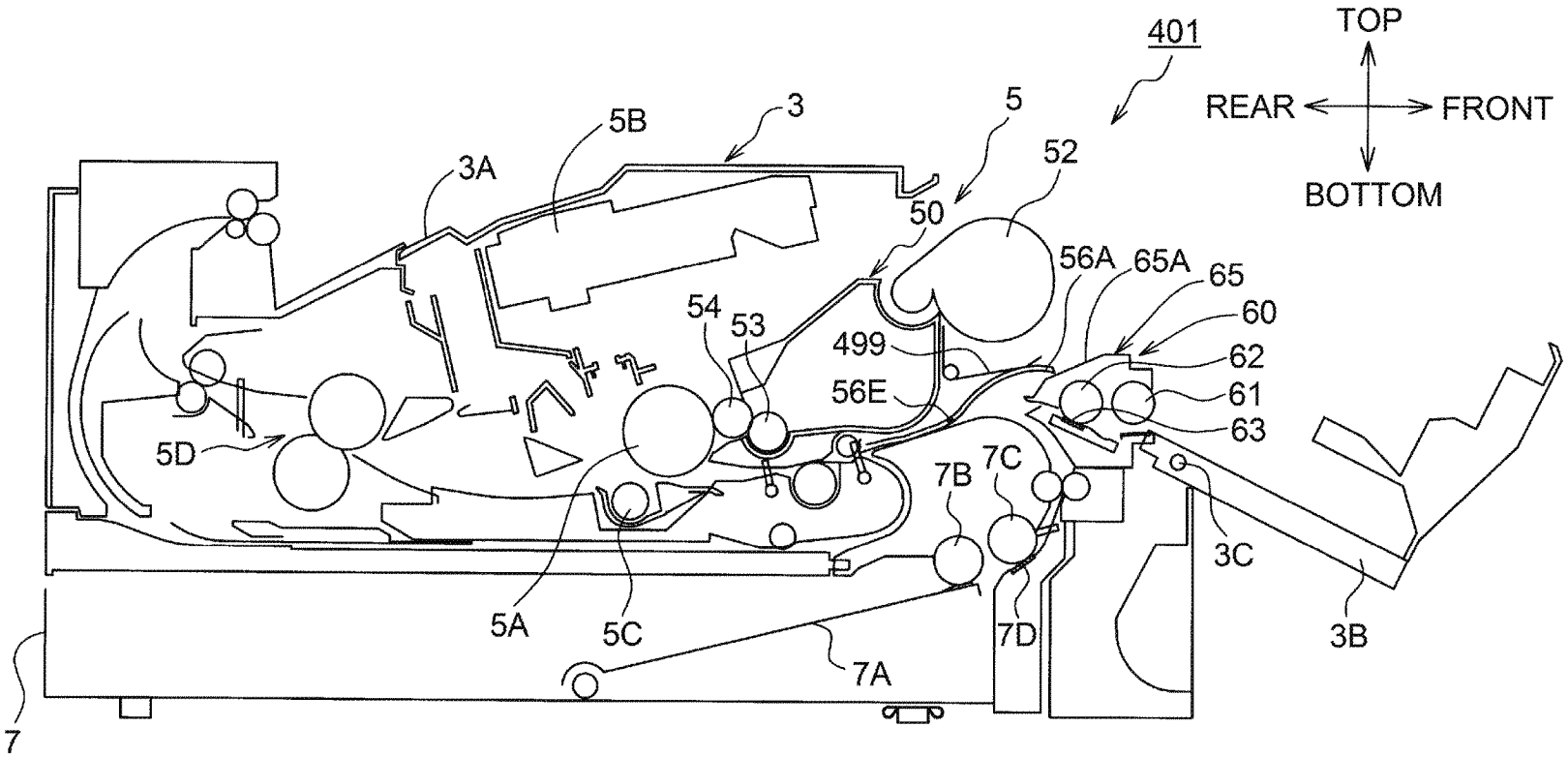
FIG. 12 is a cross-sectional view of the image forming apparatus from which a process cartridge is to be removed.

The chute 56A is continuously urged by spring 499 regardless of whether the front cover 3B is open or closed. For that reason, when the process cartridge 50 is removed from the housing 3, the chute 56A makes contact with the surface 65A and moves from the guide position to the retracted position against the urging force of the spring 499, as illustrated in FIG. 12. This therefore reduces the chute 56A from interfering with the conveyor 60 when the process cartridge 50 is removed.

2. Advantageous Effects of Fourth Embodiment

The thus-configured image forming apparatus 401 of the fourth embodiment offers the advantageous effects of (1G), (1H), (1I), (3A), (3B), and (3C) described above.

Other Embodiments

While the disclosure has been described in detail with reference to the specific embodiment thereof, this is merely an example, and various changes, arrangements and modifications may be applied therein without departing from the spirit and scope of the disclosure.

(A) Although in the above embodiments the chute 56A can be moved from the guide position to the retracted position even if the user does not touch the chute 56A directly, the present disclosure is not limited thereto. For example, the user may move the chute 56A to the retracted position by grabbing the chute 56A directly.

(B) Although in the first embodiment the chute 56A moves to the retracted position by falling down with the shaft 57 as a fulcrum, the present disclosure is not limited thereto. For example, the shaft 57 may be omitted, and a movement of the handle 56G being pulled in the removing direction of the process cartridge 50 may be converted to a movement of the chute 56A to the retracted position.

(C) In the third and fourth embodiments, the springs 399 and 499 urge the chute 56A to the guide position when the process cartridge 50 is mounted, but the present disclosure is not limited thereto. For example, the springs 399 and 499 may be merely in contact with the chute 56A without applying an urging force and may, when the chute 56A is about to move from the guide position, generate an urging force to prevent the movement.

(D) Although in the above embodiments the chute 56A translates or rotates in the vertical direction, the present disclosure is not limited thereto. For example, the chute 56A may translate in the front-rear direction to a retracted position where interference with the conveyor 60 does not occur. In that case, the chute 56A may translate in the front-rear direction to the retracted position in conjunction with the opening of the front cover 3B or may move to the retracted position in contact with the conveyor 60. However, in the case where the direction in which the guide portion, such as the chute 56A, moves from the guide position to the retracted position is a direction away from the sheet conveying path, as in the above embodiments, a space in a cartridge, such as the process cartridge 50, can be effectively used. More specifically, in the above embodiments, the space above the chute 56A can be effectively used. This therefore further reduces the need to increase the physical size of the image forming apparatus.

(E) Although in the above embodiments the chute 56A, which is an example of the guide portion, is disposed upstream of the photosensitive drum 5A, which is an example of the photosensitive member, this is given for mere illustration. For example, the guide portion may be disposed downstream of the photosensitive member or across the upstream and downstream sides of the photosensitive member. In other words, the configuration of the guide portion may be changed variously according to the configuration of the photosensitive member, etc.

(F) The conveying direction of the sheet guided by the guide portion is not limited to the horizontal direction and may be set to various directions, such as the vertical direction, according to the configuration of the photosensitive member, etc. In that case, for example, a configuration in which part of a configuration of each of the above embodiments is rotated 90 degrees can be applied.

(G) Although the above embodiments illustrate the process cartridge 50 as an example of a cartridge including a guide portion, this is given for mere illustration. For example, the cartridge may be what is called a developing cartridge devoid of a photosensitive member or a developer cartridge including only a storing portion for developer (for example, toner).

(H) Although the above embodiments illustrate the conveyor 60 as an example of the protruding portion, this is given for mere illustration. For example, the protruding portion may be another protruding portion that is absolutely necessary for the housing 3 or another component mounted to the housing 3.

(I) A plurality of functions of one element of the above embodiments may be achieved by a plurality of elements, or one function of one element may be achieved by a plurality of elements. Alternatively, respective functions of a plurality of components may be achieved by one element, or one function achieved by a plurality of elements may be achieved by one element. Part of the configurations of the embodiments may be omitted. At least part of the configurations of the embodiments may be added to or replaced by the configurations of the other embodiments. It is to be understood that all configurations included in the technical spirit specified only by the words described in the claims are embodiments of the present disclosure.

What is claimed is:

1. An image forming apparatus comprising:

a casing having an opening;

a photosensitive member disposed in the casing and configured to carry developer to be transferred onto a sheet;

an exposing device disposed in the casing and configured to expose the photosensitive member to light;

a cartridge disposed in the casing and configured to be attached to and removed from the casing through the opening, the cartridge being configured to store developer to be supplied to the photosensitive member exposed by the exposing device;

a protruding portion disposed in the casing, the protruding portion protruding toward a removal path along which the cartridge is removed, the removal path communicating with the opening of the casing; and a guide portion disposed on the cartridge and configured to, when the cartridge is attached to the casing, guide a sheet toward the photosensitive member, the guide portion being movable relative to the cartridge between a guide position where the guide portion guides a sheet and a retracted position where the guide portion is retracted from the protruding portion when the cartridge is removed from the casing.

2. The image forming apparatus according to claim 1, further comprising:

a first sheet receiving portion disposed below the photosensitive member and configured to receive a sheet;

a first sheet conveyor configured to convey the sheet received on the first sheet receiving portion toward the guide portion of the cartridge attached to the casing;

a second sheet receiving portion protruding relative to a side of the casing and configured to receive a sheet; and a second sheet conveyor configured to convey the sheet received on the second sheet receiving portion toward the guide portion of the cartridge attached to the casing, wherein the protruding portion disposed in the casing includes the second sheet conveyor.

3. The image forming apparatus according to claim 1, wherein the casing includes a cover configured to move between an open position where the opening communicating with the removal path is open and a closed position where the opening is closed, and wherein the cartridge includes a particular part connected to the guide portion, the particular part having a protruding portion configured to contact the cover when the cartridge is attached to the casing and the cover moves toward the closed position.

4. The image forming apparatus according to claim 1, wherein the guide portion is configured to move from the guide position toward the retracted position in a direction away from a conveying path of the sheet, the conveying path being defined in the casing when the cartridge is attached to the casing and the guide portion is at the guide position.

5. The image forming apparatus according to claim 4, wherein the guide portion is configured to move from the guide position to the retracted position by contacting the protruding portion when the cartridge is removed from the casing.

6. The image forming apparatus according to claim 5, wherein the guide portion is configured to move from the guide position to the retracted position by rotating in a direction away from a conveying path of the sheet, the conveying path being defined in the casing when the cartridge is attached to the casing and the guide portion is located at the guide position.

7. The image forming apparatus according to claim 4, further comprising an urging device configured to urge the guide portion in a direction directed from the retracted position toward the guide position and support the guide portion at the guide position against a force received from the sheet.

8. The image forming apparatus according to claim 7, wherein the urging device is configured to, when the cartridge is attached to the casing, urge the guide portion in the direction directed from the retracted position toward the guide position.

9. The image forming apparatus according to claim 8, wherein the urging device includes a spring.

10. The image forming apparatus according to claim 9, wherein the casing includes a cover configured to move between an open position where the opening communicating with the removal path is open and a closed position where the opening is closed, and wherein the urging device is disposed on a surface of the cover facing the cartridge.

11. The image forming apparatus according to claim 4, wherein the cartridge includes a storing portion configured to store developer, the storing portion being disposed above the guide portion when the cartridge is attached to the casing.

12. The image forming apparatus according to claim 1, further comprising a moving portion configured to move the guide portion from the guide position to the retracted position in response to removal of the cartridge from the casing.

13. The image forming apparatus according to claim 12, wherein the casing includes a cover configured to move between an open position where the opening communicating with the removal path is open and a closed position where the opening is closed, and wherein the moving portion is configured to move the guide portion from the guide position to the retracted position in conjunction with the cover moving toward the open position.

14. The image forming apparatus according to claim 13, wherein the moving portion includes:

an extending portion configured to stand in conjunction with the cover moving toward the closed position; and a conversion portion configured to convert a movement of the extending portion falling in conjunction with the cover moving toward the open position, to a movement of the guide portion moving from the guide position to the retracted position.

15. The image forming apparatus according to claim 12, wherein the cartridge includes a handle for removing the cartridge from the casing, and wherein the moving portion is configured to convert a movement of the handle being pulled in a removing direction of the cartridge, to the movement of the guide portion moving from the guide position to the retracted position.

16. The image forming apparatus according to claim 15, wherein the guide portion is configured to move from the guide position to the retracted position by rotating in a direction away from a conveying path of the sheet, the conveying path being defined in the casing when the cartridge is attached to the casing and the guide portion is located at the guide position.

17. The image forming apparatus according to claim 1, wherein the casing includes a cover configured to move between an open position where the opening communicating with the removal path is open and a closed position where the opening is closed, and wherein the guide portion is configured to move to the guide position in conjunction with the cover moving toward the closed position.

18. A cartridge for use in an image forming apparatus, the image forming apparatus including a casing, a photosensitive member disposed in the casing and configured to carry developer to be transferred onto a sheet, and an exposing device disposed in the casing and configured to expose the photosensitive member to light, the cartridge being configured to be attached to and removed from the casing of the image forming apparatus, the cartridge comprising:

a frame; and a guide portion configured to guide a sheet toward the photosensitive member, the guide portion being movable relative to the frame between a guide position where the guide portion guides the sheet and a retracted position spaced apart from the guide position in a direction away from a conveying path of the sheet.

* * * * *